US007945971B2

(12) United States Patent
Garza

(10) Patent No.: US 7,945,971 B2
(45) Date of Patent: May 24, 2011

(54) HAT WITH HAIR-GATHERING FEATURE

(76) Inventor: Sandra Garza, West Chicago, IL (US)

( * ) Notice: Subject to any disclaimer, the term of this patent is extended or adjusted under 35 U.S.C. 154(b) by 645 days.

(21) Appl. No.: 12/002,200

(22) Filed: Dec. 14, 2007

(65) Prior Publication Data

US 2009/0151047 A1 Jun. 18, 2009

(51) Int. Cl.
*A42B 1/20* (2006.01)

(52) U.S. Cl. ..... 2/209.3; 2/171.4

(58) Field of Classification Search ..... 2/171.1, 2/171.4, 172, 182.8, 209.14, 209.3, 209.7
See application file for complete search history.

(56) References Cited

U.S. PATENT DOCUMENTS

| | | | | |
|---|---|---|---|---|
| D173,620 | S | 12/1954 | Krieger et al. | |
| 2,753,566 | A | 7/1956 | Pereleman | |
| 3,357,070 | A | 12/1967 | Sloan | |
| 4,998,544 | A | 3/1991 | Obergfell | |
| 5,170,509 | A | 12/1992 | Leopold | |
| D343,274 | S | 1/1994 | Paterek | |
| 5,321,854 | A | 6/1994 | Kronenberger | |
| 5,325,540 | A | 7/1994 | Kronenberger | |
| D350,427 | S | 9/1994 | Vig et al. | |
| 5,509,145 | A | 4/1996 | Stevenson | |
| 5,511,249 | A | 4/1996 | Higgins | |
| 5,535,454 | A | 7/1996 | Ryan | |
| 5,539,929 | A | 7/1996 | Revson | |
| 5,598,585 | A | 2/1997 | Stroup | |
| 5,644,799 | A | 7/1997 | Armenta et al. | |
| 5,799,334 | A | 9/1998 | Griffith et al. | |
| 5,875,488 | A | 3/1999 | Milani | |
| 5,875,494 | A | 3/1999 | Garnier et al. | |
| 5,933,872 | A | 8/1999 | Lema | |
| 6,401,255 | B1 | 6/2002 | Douglas | |
| 7,047,571 | B1 | 5/2006 | Kelly | |
| 2003/0009813 | A1 * | 1/2003 | Dreher | 2/171 |
| 2004/0006809 | A1 | 1/2004 | Crenshaw et al. | |
| 2005/0066421 | A1 * | 3/2005 | Brundage | 2/209.3 |
| 2005/0108810 | A1 | 5/2005 | Yan | |
| 2006/0117461 | A1 | 6/2006 | Kelly | |
| 2006/0168712 | A1 | 8/2006 | Maxxoccoli et al. | |
| 2006/0191057 | A1 * | 8/2006 | Lynn | 2/171 |
| 2006/0277658 | A1 | 12/2006 | Marsh et al. | |
| 2007/0250987 | A1 * | 11/2007 | Adkins | 2/209.3 |
| 2009/0199323 | A1 * | 8/2009 | Zakarian | 2/209.14 |

* cited by examiner

*Primary Examiner* — Katherine Moran
(74) *Attorney, Agent, or Firm* — Meroni & Meroni, P.C.; Charles F. Meroni, Jr.; Christopher J. Scott

(57) ABSTRACT

A hair-gathering hat construction comprises a hair-gathering aperture, which hat construction essentially comprises a crown portion, a brim portion, and hat cinching structure for cinching the crown and brim portions against the head of a user for effecting a proper fit. The crown portion defines a head-receiving opening and comprises inferior and posterior crown sections. The inferior crown section is peripherally discontinuous at the posterior crown section for defining an upper hair-receiving notch. The brim portion defines certain head-receiving structure and comprises a superior brim section, a posterior brim section, and brim flaps. The superior brim section extends from the inferior crown section at a crown-to-brim junction. The superior and posterior brim sections define a lower hair-receiving notch. The upper and lower notches together define a hair gathering aperture. The brim flaps form annular head-receiving structure when juxtaposed one another. The cinching structure retains the brim flaps in juxtaposed relation.

19 Claims, 9 Drawing Sheets

HAT WITH HAIR-GATHERING FEATURE

PRIOR HISTORY

This application claims the benefit of pending U.S. patent application Ser. No. 11/897,336 filed in the United States Patent and Trademark Office on Aug. 30, 2007.

BACKGROUND OF THE INVENTION

1. Field of the Invention

The present invention generally relates to a combination article which may function as both a hat and a hair-gathering device. More particularly, the present invention relates to a hat having hair-gathering features for forming ponytail or pigtail type structures via the hat construction.

2. Description of Related Art

A number of prior art patents disclose a head covering which may also function as ponytail-forming or pigtail-forming headwear. Some of the more pertinent prior art relating to headwear of this type are briefly described hereinafter.

U.S. Pat. No. 2,753,566 ('566 patent), which issued to Perelman, discloses a Headpiece. The headpiece according to the '566 patent comprises a generally circular crown including a plurality of radially and upwardly extending flexible leaves joined at the base of the crown and having tapered upper free ends, a snap fastener element disposed near the upper free end of each leaf, a generally circular member carrying a plurality of uniformly spaced snap fastener elements near it periphery, and a snap fastener element disposed near the base of each lead, said fastener elements on said circular member and at the bases of said leaves being engageable with the fastener elements at the free ends of said leaves, whereby the headpiece has the configuration of a closed cap when the circular member is attached to the free ends of all of the leaves by means of the fastener elements at said free ends of the leaves and the fastener elements on said circular member, and whereby the headpiece has a selected degree of opening in the crown when at least one lead is curled and its free end is attached to the snap fastener element at the base of the leaf by means of the fastener element at the free end of said leaf.

U.S. Pat. No. 3,357,070 ('070 patent), which issued to Sloan, discloses certain Accessories for Hairdos and Articles of Apparel. The '070 patent describes a flexible disk-like sheet member having a plurality of slits extending radially from a point centrally of the member to provide a plurality of triangular fingers which extend in one direction from flexure of the disk as a pony tail or object to be clamped is passed through the disk in a direction opposite to the direction of it flexure so that the fingers firmly grip the pony tail or object when the disk-like member springs back to is unstressed and the device is removable by flexing the disk in the opposite direction causing the fingers to unleash the pony tail or object.

U.S. Pat. No. 5,321,854 ('854 patent), which issued to Kronenberger discloses a Headwear Piece with Opening to Accommodate Wearer's Hair. The '854 patent describes a headwear piece having a crown defining an opening to accept the head of a wearer, with the crown having a top and bottom, front and back, and a peripheral wall having an annular configuration. An opening is provided through the peripheral crown wall to allow passage therethrough of an accumulation of hair on the head of a wearer with the headwear piece in place on the wearer's head.

U.S. Pat. No. 5,509,145 ('145 patent), which issued to Stevenson et al., discloses a Cap with Opening having a Removable Closure. The '145 patent describes a headwear item, more particularly a baseball-style cap, having a hole at the top of the crown for a ponytail or braid to pass through and a removable closure that conceals the hole at the option of the wearer. The cap also has a pocket sewn on the inside of the crown to allow the stowage of the removable closure when it is not in use. This arrangement allows the cap to be worn by men and women with short hair as well as by those who wear their hair in a ponytail or braid.

U.S. Pat. No. 5,511,249 ('249 patent), which issued to Higgins, discloses a Cap with Crown Opening. The '249 patent describes a head cap having an opening on its upper central or crown portion of the cap body, the opening being for receiving a "ponytail" hair style, with the walls around the opening providing lateral support to the ponytail. A neat and trim appearance of the ponytail extending through the opening is achieved, and the attractive vertical support is given to the ponytail even though given only by lateral support. In another embodiment, at least two openings are provided, spaced laterally of the median line of the cap body, accommodating a dual ponytail style.

U.S. Pat. No. 5,535,454 ('454 patent), which issued to Ryan, discloses a Protective Helmet with Hair Entraining Aperture. The '454 patent describes a protective helmet suitable for safe use by a person having long hair. The helmet includes an outer dome-shaped shell of impact-resistant material configured to fit on the head of a wearer. A liner affixed to the inside of the shell snugly positions the helmet on the head and dissipates impact forces received by the outer shell. An aperture formed through the rear portion of the helmet is sized to enable the wearer's hair to be gathered and entrained therethrough, but is sized small enough to prevent harmful impact penetration of an object such as a ball, hockey puck or the like with the wearer's head.

U.S. Pat. No. 5,644,799 ('799 patent), which issued to Armenta et al., discloses a Headgear Accessory. The '799 patent describes a headgear accessory adaptable to an existing cap, hat, hood, or other article worn on the head, to cover a hole or passage formed therein to provide for the passage of the hair of the wearer therethrough. Using the present headgear accessory, a hole may be placed in the headgear at a location comfortable for the passage of longer hair (e.g., ponytail, braid, etc.) therethrough, and the accessory sewn or otherwise secured to the headgear to provide a decorative closure for the hole. The accessory is preferably formed of a resilient, flexible material such as neoprene sheet, with a synthetic fabric overlay for additional strength and to provide a more attractive appearance. A series of slots are formed in the neoprene/fabric sheet, through which the wearer's hair is passed. The resilient nature of the sheet material biases the material to each side of each of the slots against the hair, thereby providing greater security for the headgear on the wearer's head and yet providing for ease of removal of the headgear. The periphery and edges of the slots of the accessory may be stitched for greater durability and to provide an attractive appearance, if desired. The accessory may be provided separately, or in combination with various types of hats, caps, hoods, and/or other headgear of virtually any type.

U.S. Pat. No. 5,799,334 ('334 patent), which issued to Griffith et al., discloses a Baseball cap for pigtail hairstyles. The '334 patent describes a baseball cap to accommodate pigtail and non-bundled hairstyles comprises a head covering portion formed from a front panel spaced-apart from a back panel by a plurality of side panels. Each side panel includes an opening bound by elastic. The openings are formed by overlapping tabs and selectively covered by a flap. Each opening is sized to accept a bundle of hair passed therethrough. A light deflecting brim extends outward from the front panel.

U.S. Pat. No. 5,875,494 ('494 patent), which issued to Garnier et al., discloses a Headwear with Closable Hair Opening. The '494 patent describes a baseball-type cap with a closable opening that extends down the crown seam at the back of the cap. The opening is held closed by means of snaps attached to the overlapping portions of material at the seam edges, and is opened by separating the snaps. The opening extends from the top center of the cap to the rear vent, but does not intersect the adjustment strap opening. This maintains the ability of the cap to be adjusted to fit different head sizes. A wearer can open the closure, allowing a ponytail to extend through it with the cap in place on the wearer's head. The cap functions as normal with the opening snapped shut.

U.S. Pat. No. 5,933,872 ('872 patent), which issued to Lema, discloses a Pony Tail Cap. The '872 patent describes a head cap having a substantially hemispherically shaped portion intended to be worn over hair on the head of a wearer and including at least one opening therein large enough to accommodate a bundle of hair passing through the opening and means for securing the cap to the bundle of hair. A gathering mechanism is attached to the cap body around the perimeter of the opening to compressively engage the bundle of hair and hold the bundle of hair and the cap body in a fixed relationship. The gathering mechanism includes a sleeve attached to the cap body along the perimeter of the opening and a drawstring passed through the interior of the sleeve. The drawstring may be drawn to gather the sleeve to compressively engage the bundle of hair. A clamp is provided for holding the drawstring in a drawn disposition to hold the sleeve gathered about the bundle of hair.

U.S. Pat. No. 7,047,571 ('571 patent), which issued to Kelly, discloses a Ponytail Cap. The '571 patent describes an apparel item comprising: a cap, a plurality of cooperating fastening means located within the cap interior, and a hair accessory piece which simulates the appearance of human hair.

United States Patent Application No. US 2004/0006809, which was authored by Crenshaw et al. describes an adjustable aperture containing hat apparatus comprising a head-covering portion, an aperture portion defined by the head-covering portion, and an aperture size adjustment assembly attached to the head-covering portion, adjacent to the aperture portion, for adjusting the size of the aperture portion. Preferably, the aperture portion is located at a top central portion of the head-covering portion. Ordinarily, a hat brim is attached to the head-covering, but can be brimless. With using the adjustable aperture containing hat apparatus, a person's hair braids (ponytail or dreadlocks) can be threaded through the aperture portion, and the aperture size adjustment assembly contracts around the bases of the hair braids (ponytail or dreadlocks).

United States Patent Application No. US 2005/0066421 which was authored by Brundage, describes a hat which comprising a hole surrounded by stitching that provides a barrier from unraveling or unweaving of the hat. The hat provides a hole for a ponytail to extend through such that the wearer's hair does not cause air gaps which would otherwise reduce the hat's effectiveness in protecting the wearer from environmental elements.

United States Patent Application No. 2006/0277658 which was authored by Marsh et al., describes caps and hats which are constructed to focus attention on one of two somehow related but different subjects. A baseball-style cap may have two identical fixed visors or bills positioned opposite to each other, a harlequin type of color scheme (front versus rear) and permanently affixed front and rear indicia that depict two opponents or contenders in a competition. It may also commemorate a competition or game, as by one or more laterally placed event indicia, and it may be adjustable to promote the fitting of different head sizes through the use of stretchable material in the lateral aspects of both the crown and the headband. By a simple front to rear rotation of the cap, the wearer might reverse his or her loyalty as, for example, should the team of preference suffer defeat in the contest. Openings allow a ponytail to be routed through either crown at a location centrally above the visor.

It may be seen from an inspection of the prior art that the art is silent on a hat construction having hair-receiving or hair-gathering notches formed in the body of the hat for guiding or channeling hair during hat adornment for easing ponytail or pigtail formation via the hat construction. The prior art thus perceives a need for such a combination article, the particulars of which are set forth in more detail hereinafter.

SUMMARY OF THE INVENTION

In view of the fact that the prior art is silent on a hat construction having hair-receiving or hair-gathering notches formed in the body of the hat for guiding or channeling hair during hat adornment for easing ponytail or pigtail formation via the hat construction, a primary object of the present invention is to provide a versatile article of the sort here introduced, which may be manufactured in a convenient, durable and inexpensive manner. To achieve these and other readily apparent objectives, the hair-gathering hat construction of the present invention essentially discloses a hair-gathering hat construction for effecting a hair-gathering aperture, which hat construction essentially comprises a crown portion, a brim portion, and means for cinching the crown and brim portions against the head of a user for effecting a proper fit therebetween.

The crown portion defines a head-receiving opening and comprises superior, inferior, anterior, posterior, and lateral crown sections. The superior crown section is generally peripherally continuous, and the inferior crown section is peripherally discontinuous at the posterior crown section or lateral crown sections for defining one or more upper hair outlet(s) or hair-receiving notches. The brim portion defines certain head-receiving structure and comprises a superior brim section, a posterior brim section, an anterior brim section, lateral brim sections, and brim termini or brim flaps.

The superior brim section integrally extends from the inferior crown section at a crown-to-brim junction. The superior and posterior (or lateral) brim sections define a lower hair outlet or lower hair-receiving notch. The upper and lower hair outlets or notches together define a hair gathering aperture. The brim termini form annular head-receiving structure when juxtaposed one another. The brim termini may preferably overlap when juxtaposed one another, and the cinching or retainer means may well function to retain the brim termini in overlapped relation when juxtaposed one another. The hair-gathering aperture may be further bound by elastic for effecting an enhanced hair-gathering function.

BRIEF DESCRIPTION OF THE DRAWINGS

Other features of my invention will become more evident from a consideration of the following brief description of patent drawings.

DETAILED DESCRIPTION OF THE PREFERRED EMBODIMENT(S)

Figure 1:
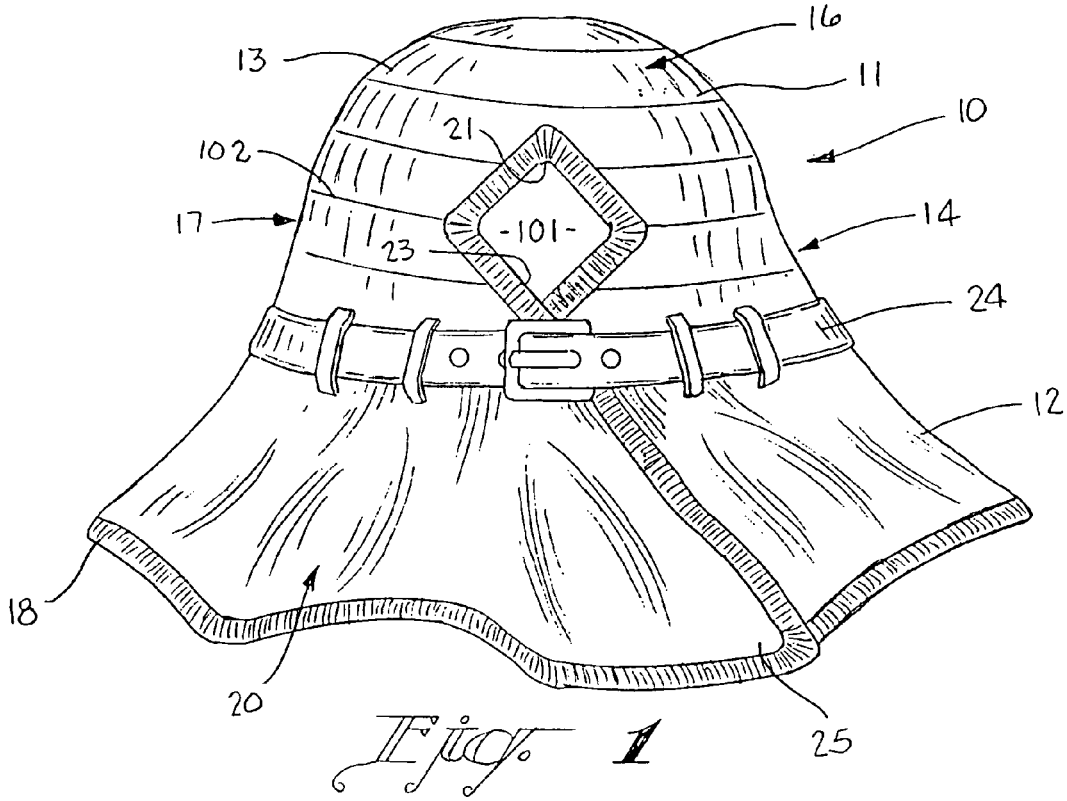
FIG. 1 is a posterior type depiction of the preferred hat construction according to the present invention with diamond shaped hair-letting aperture and a fully crown-encircling strap for adjustably cinching the crown and brim portions against a user's head.

Hats may be worn for any number of reasons. Most typically, hats may be worn for fashion and for providing certain head-containing, head-covering, or hair-concealing means, or for maintaining the user's head in a preferred temperature state (i.e. the hat may be worn to keep the head warm or cool), or for protecting the user's head from the elements. Ponytail holders also help the user maintain certain anatomy in a preferred temperature state by lifting hair off of, or away from, the neck area thereby providing the user with an effective means of neck ventilation at minimal cost. The present invention concerns a hair-gathering hat construction 10 comprising both a hair-concealing hat portion with an incorporated hair-gathering, ponytail-enabling feature. The preferred hair-gathering hat construction 10 according to the present invention is generally illustrated and referenced in FIGS. 1-6, and 17. An alternative embodiment of the hair-gathering hat construction 20 according to the present disclosure is generally illustrated and referenced in FIGS. 9-12.

It is contemplated that the hair-gathering hat construction 10 primarily functions to enables the wearer to gather or entrain hair into a ponytail or pigtail type structure(s) by way of a hair-gathering aperture or opening made integral with the hat construction. To achieve this primary function, the hat construction 10 according to the present invention essentially comprises a crown portion 11 as illustrated and referenced in FIGS. 1-6, and 9-12; a brim portion as illustrated and referenced in FIGS. 1-6, 11, and 12; and certain means for cinching the crown and brim portions 11 and 12 against the head of a user to ensure a proper fit.

The crown portion 11 of the preferred embodiment defines a head-receiving opening which receives the crown portion of a user's head and comprises a superior crown section 13, an inferior crown section 14, an anterior crown section 15, and a posterior crown section 16. From an inspection of the drawings, it may be seen that the inferior and posterior crown sections of the preferred embodiment together define or comprise an upper hair outlet or upper hair-receiving notch 21. The upper hair outlet or hair-receiving notch 21 may be defined by the upper boundary or structure surrounding the opening or aperture as referenced at 101 in FIGS. 1, 2, 7, and 8.

Figure 7:
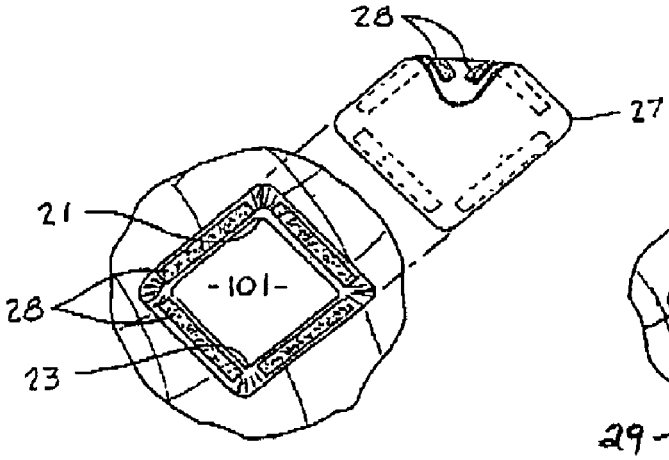
FIG. 7 is a fragmentary interior view of a hair-letting aperture outfitted with one of cooperable hook and loop fastening structure with a patch-like structure exploded therefrom, which patch-like structure is outfitted with a second of cooperable hook and loop fastening structure for selectively covering the hair-letting aperture, when not in hair-gathering use.
Figure 8:
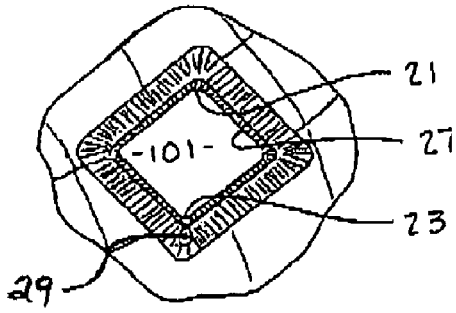
FIG. 8 is a fragmentary interior view of a hair-letting aperture outfitted with zipper structure for receiving a patch-like structure cooperably outfitted.
Figure 9:
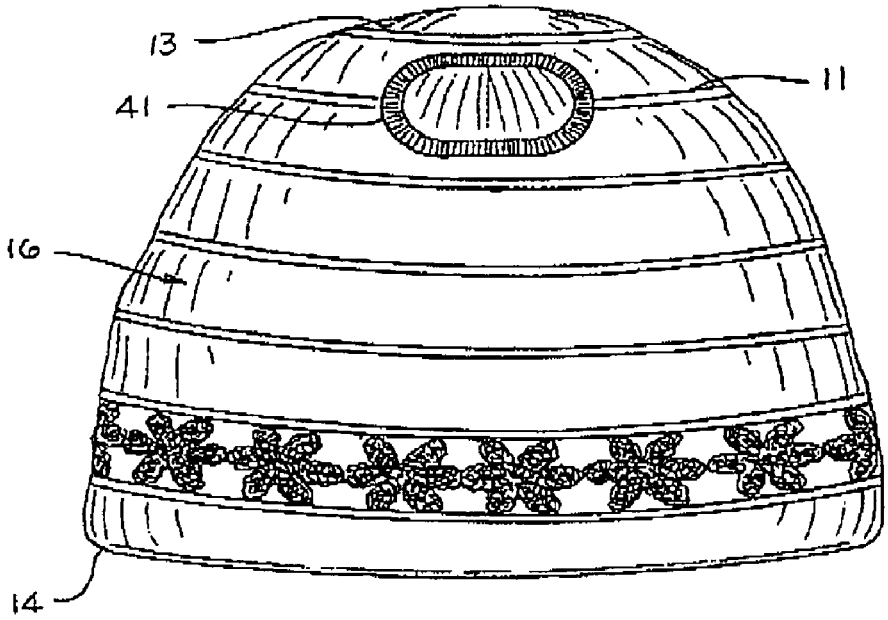
FIG. 9 is a posterior type depiction of an alternative hat construction according to the present invention with oval-shaped and elasticized hair-letting aperture.

It is contemplated that the opening or aperture 101 may be defined by any number of shapes, including, but not limited to diamond shaped or rectangular shaped aperture as depicted in FIGS. 1, 2, 5, 7, and 8; an oval shaped aperture as generally depicted in FIG. 9; or a circular shaped aperture as generally depicted in FIGS. 13-16. Other aperture shapes may include softened rectangles (in which the corners are rounded), triangular shaped apertures, and any number of various polygon shapes. So long as the upper notch 21 may align itself and complement the lower notch 23 to form a hair-letting aperture 101, it is believed that the spirit of the hat construction 10 is practiced.

Figure 14:
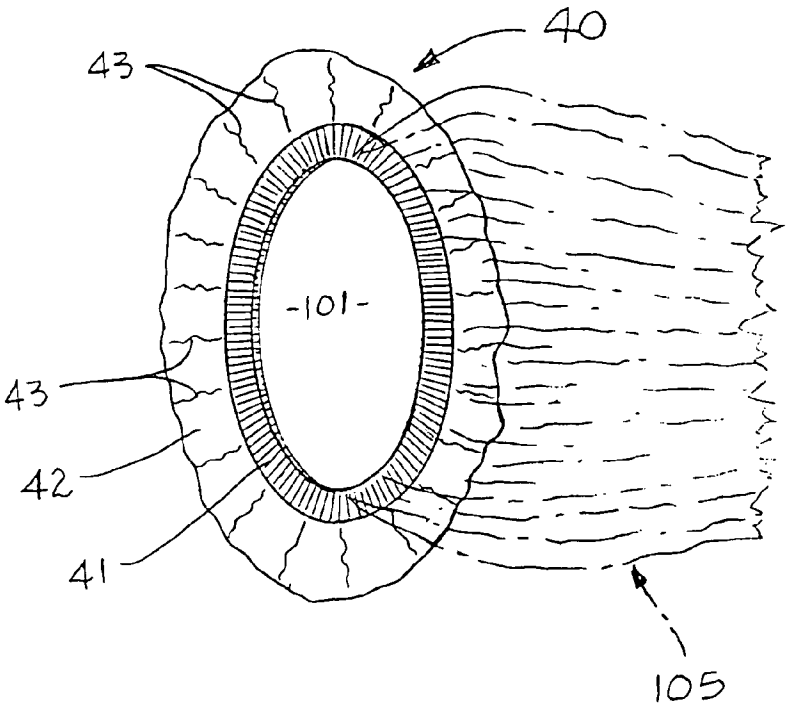
FIG. 14 is a fragmentary perspective type depiction of the hair-gathering assembly otherwise depicted in FIG. 13 showing phantom hair received via the hair-letting aperture.
Figure 13:
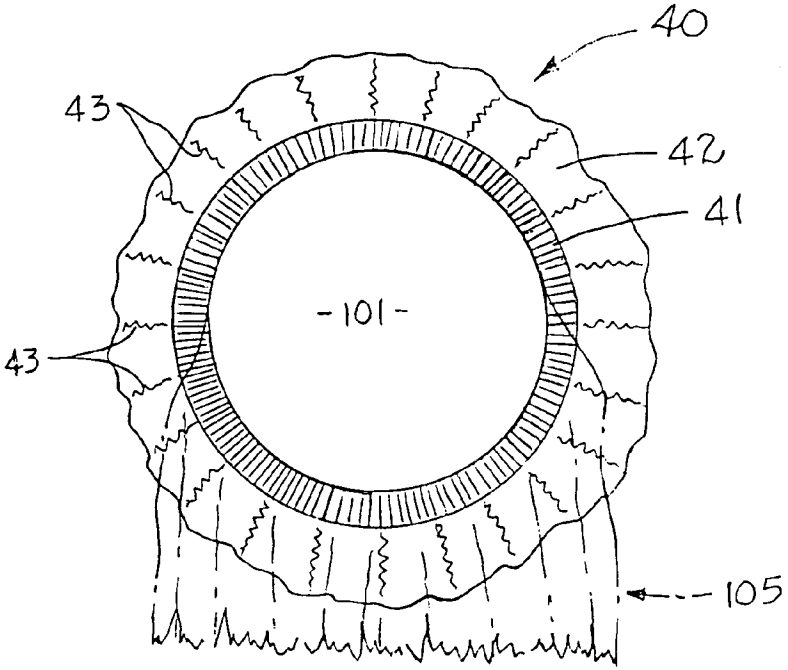
FIG. 13 is a fragmentary plan type depiction of a hair-gathering assembly (incorporated into the hat construction of the present invention) in an actuated, hair-receiving configuration.
Figure 16:
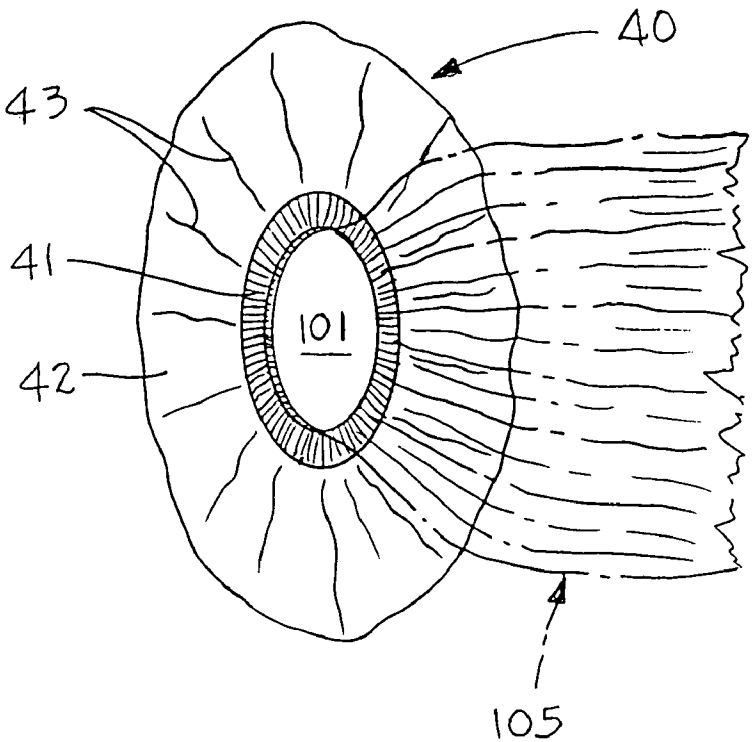
FIG. 16 is a fragmentary perspective type depiction of the hair-gathering assembly otherwise depicted in FIG. 15 showing phantom hair gathered or pinched via the hair-letting aperture.
Figure 15:
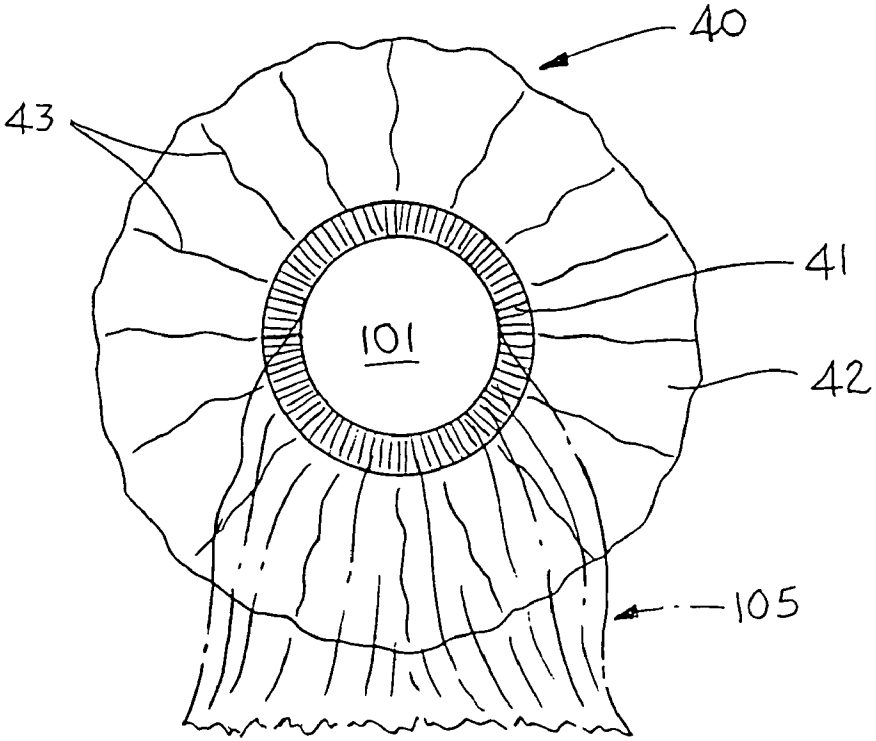
FIG. 15 is a fragmentary plan type depiction of the hair-gathering assembly a relaxed, hair-gathering or hair-pinching configuration.
Figure 17:
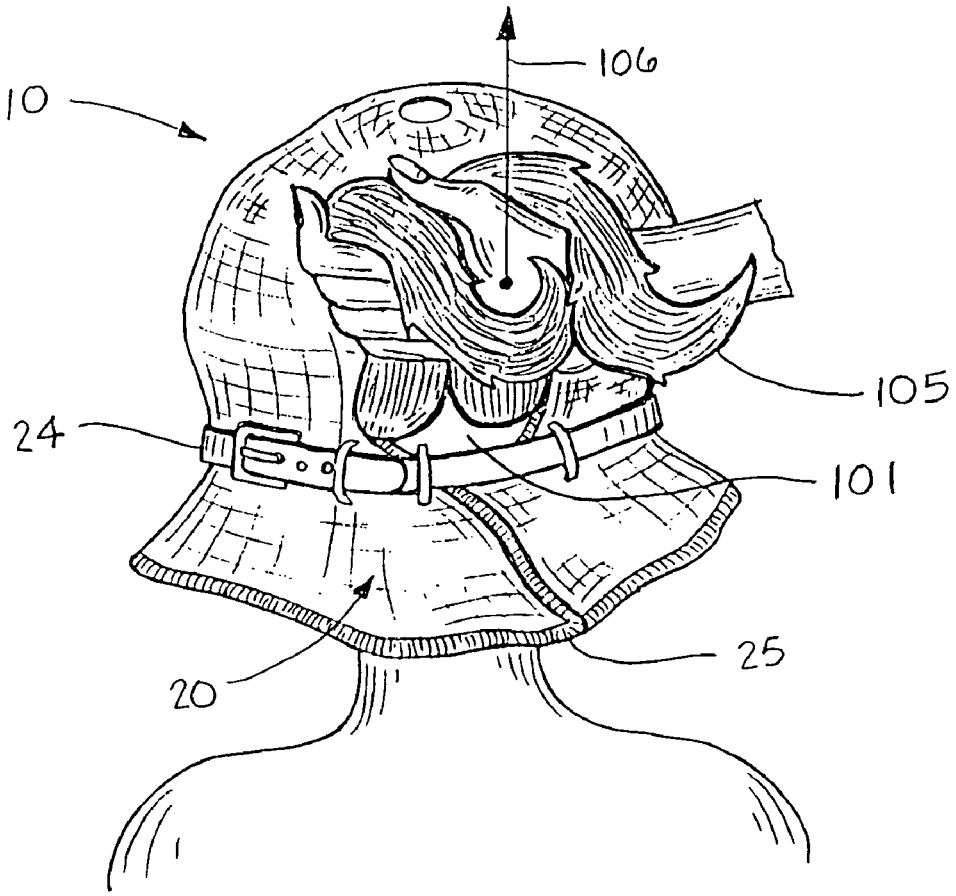
FIG. 17 is a posterior type depiction of the preferred hat construction as donned upon a user's head with a hand manually lifting entrained hair from the lower hair-receiving notch toward the upper hair-receiving notch.

Further, it is contemplated that the opening or aperture 101 may be optionally bound by, or may optionally comprise certain elastic media for enabling the user to expand the aperture 101 to a hair-receiving, actuated configuration from a relaxed, hair-gathering configuration. In other words, the upper portions of brim termini 25 that define the lower hair-receiving notch 23 and those portions of the inferior (and posterior) crown section(s) that define the upper hair-receiving notch 21 may be elastically actuable. The hair-receiving, actuated configuration is generally depicted in FIGS. 13 and 14, and the hair-gathering (or hair-pinching), relaxed configuration is generally depicted in FIGS. 15 and 16. In keeping with the foregoing, the circular aperture depicted in FIGS. 13-16 is believed to be exemplary for ease of illustration, and should not be construed as limiting.

The brim portion 12 defines a ring shaped structure or head-receiving annulus integrally extending from the inferior crown section 14 and comprises a superior brim section 17, and inferior brim section 18 (i.e. that section which lies in a plane initially broken when the hat is donned), an anterior brim section 19, and a posterior brim section 22. It may be readily seen from an inspection of the figures that the superior brim section 17 is integrally formed with or extends from the inferior crown section 14 at a crown-to-brim junction as generally referenced at 102.

Crown-to-brim junction 102 is generally depicted with a solid line 102 in FIG. 1, and broken lines in FIGS. 2-5. It may be further seen from an inspection of the noted figures that the superior and posterior brim sections 17 and 20 define or comprise a lower hair outlet or lower hair-receiving notch 23. Together, the upper and lower hair outlets 21 and 23 define the hair-gathering aperture 101.

Figure 5:
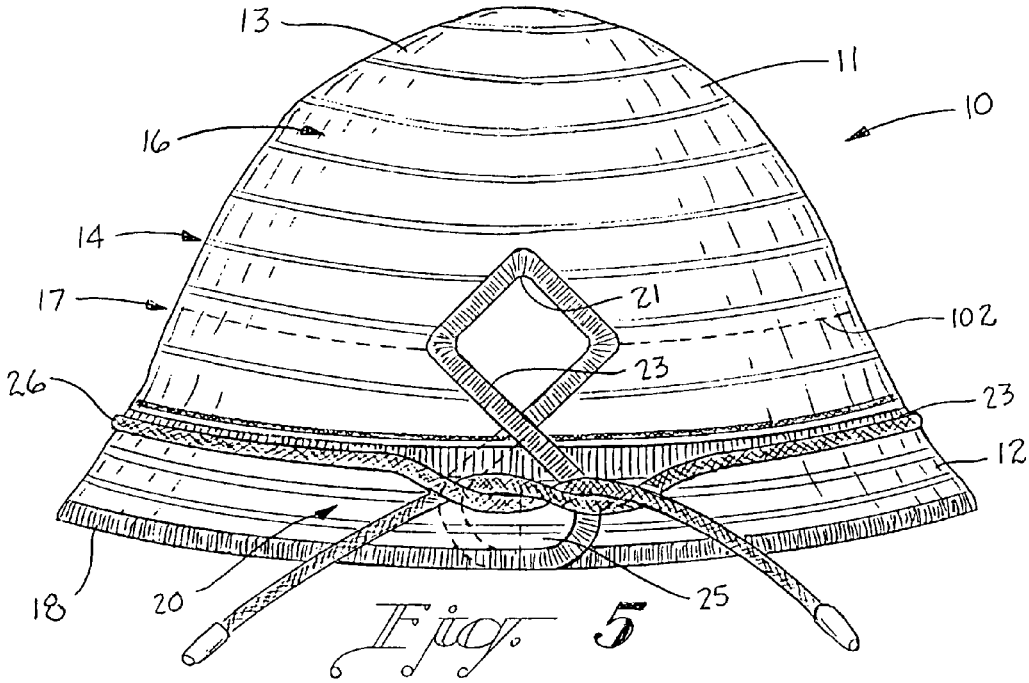
FIG. 5 is a posterior type depiction of the preferred hat construction according to the present invention with diamond shaped hair-letting aperture as defined by overlapping brim termini and a fully crown-encircling cord for adjustably cinching the crown and brim portions against a user's head.

Notably, the ring-shaped brim portion or head-receiving annulus is discontinuous or broken such that the brim portion comprises brim termini as referenced at 25 in FIGS. 1, 2, 5, and 6. Together, the upper edges of opposing brim termini 25 function to form the lower hair outlet or hair-receiving notch 23. The head-receiving annulus of the brim portion 12 may thus be said to be broken or discontinuous from the lower hair outlet 23 to the inferior and posterior brim sections 18 and 20. Preferably, the brim termini 25 are mirror images of one another and are sized and shaped so as to overlap one another as generally depicted in FIG. 5, which shows the otherwise concealed and lapped brim terminus 25 in broken lines.

It is contemplated that the overlapping brim termini 25 may well function to provide a one size fits all type hat construction 10 insofar as the termini may enable adjustment of the hat construction 10 to accommodate heads of various sizes without detracting from the overall appearance of the hat construction 10. In this regard, it will be recalled that hat wearers don hats for fashionable reasons as well as utilitarian reasons.

The overlapping brim termini 25 feature enables the user to effectively expand or contract the diameter of the head-receiving annulus for receiving variously sized heads and provides a relatively uniform overall appearance from diameter to diameter. The hair-gathering hat construction 10 thus comprises lapping brim termini 25 at the point of annular discontinuity or adjacent the discontinuous annulus.

Figure 2:
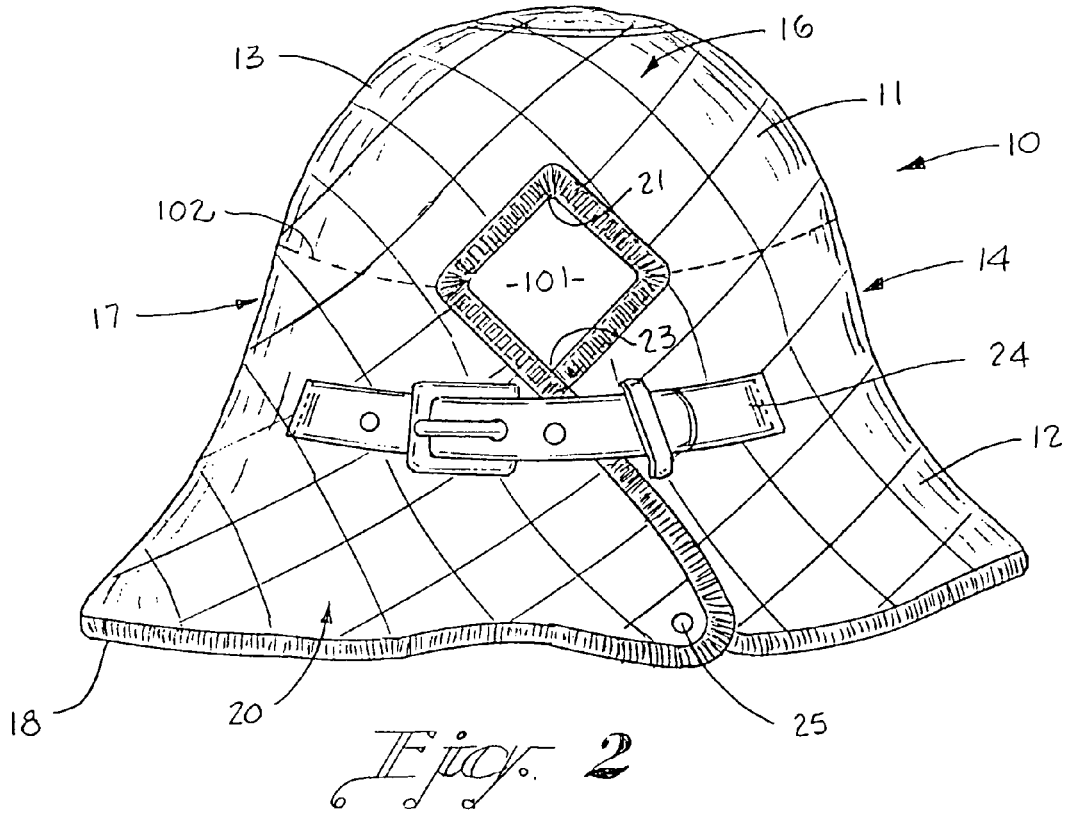
FIG. 2 is a posterior type depiction of the preferred hat construction according to the present invention with diamond shaped hair-letting aperture and a partially crown-encircling strap for adjustably cinching the crown and brim portions against a user's head.
Figure 3:
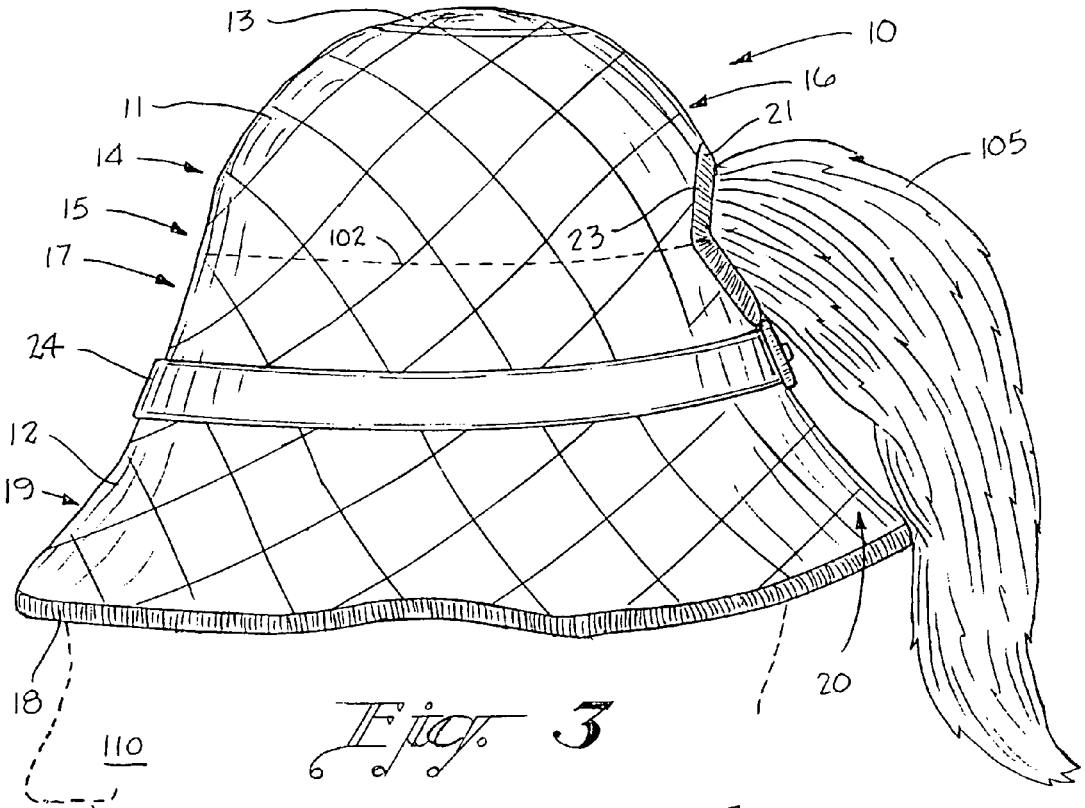
FIG. 3 is a lateral type depiction of the preferred hat construction according to the present invention with diamond shaped hair-letting aperture, a fully crown-encircling strap for adjustably cinching the crown and brim portions against a user's head, and a ponytail structure extending from the hair-letting aperture.
Figure 4:
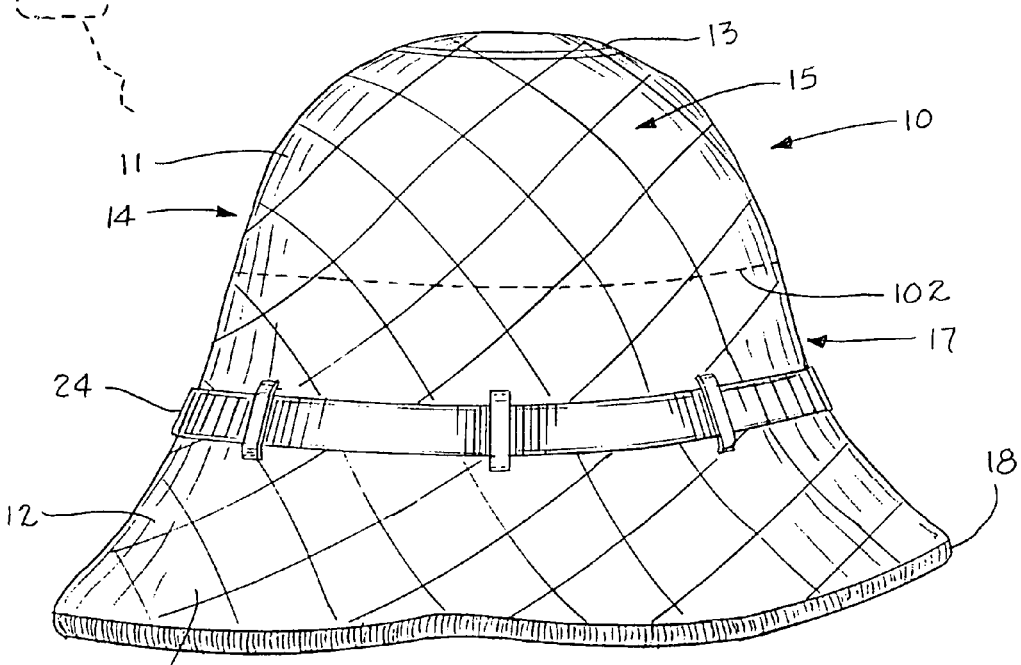
FIG. 4 is an anterior type depiction of the preferred hat construction according to the present invention with a fully crown-encircling strap for adjustably cinching the crown and brim portions against a user's head.

As earlier introduced, the hat construction 10 further preferably comprises certain cinching means for cinching the crown and brim portions 11 and 12 against a head as received via the brim and crown portions. In this regard, it is contemplated that the cinch means may be preferably defined by certain strap structure 24 as referenced in FIGS. 1-4; or certain tie or cord-like structure 26 as referenced in FIGS. 5 and 6. It is contemplated that the strap structure 24 (outfitted with cooperative buckle and length adjustment apertures) (or cord-like structure 26) may peripherally encircle the hat construction 10 as generally depicted in FIGS. 1, and 3-6; or partially embrace an arc length around the hat construction 10 as generally depicted in FIG. 2.

Figure 6:
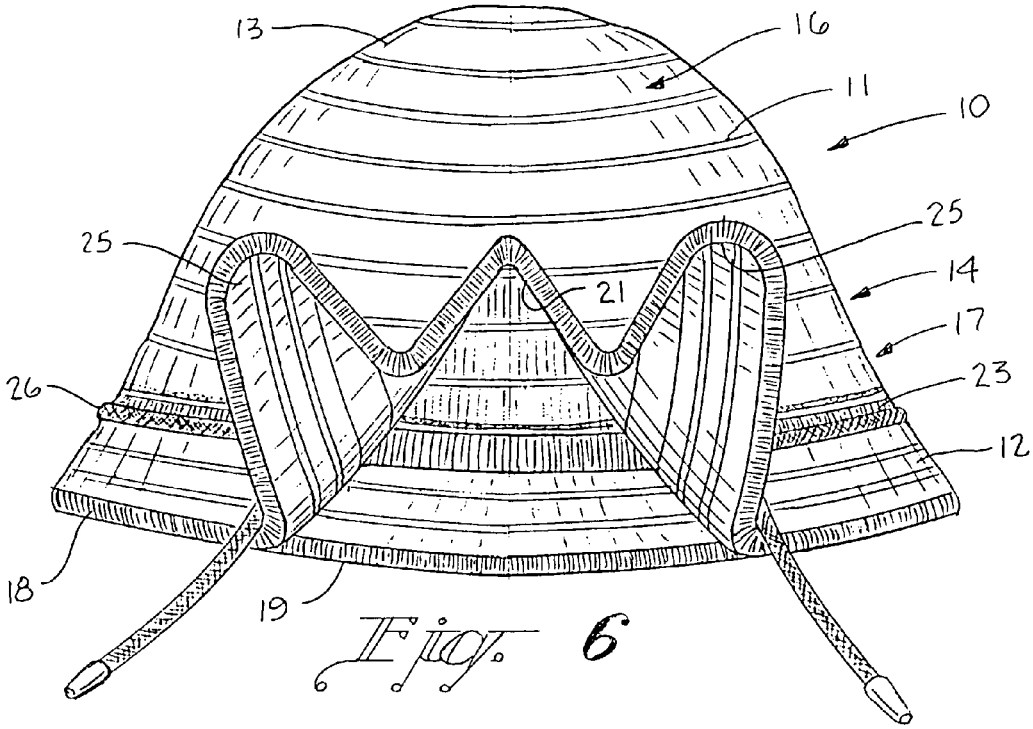
FIG. 6 is a posterior type depiction of the preferred hat construction according to the present invention with the brim termini in an open state for receiving and channeling hair into a notch terminus or groove formed at the pinnacle of the upper hair-receiving notch.

In either case, it is contemplated that the cinching means are attached to the hat construction adjacent the brim termini 25 so as to enable the user to pull the brim termini 25 toward one another for contracting the head-receiving annulus and crown portions of the hat construction 10. Further, as generally depicted in FIGS. 5 and 6, it is contemplated that an outer or exterior hat surface of the hat construction 10 may be provided a tie-camouflaging pattern (as at 23), which pattern may well function to camouflage the cord-like structure (26) (or strap structure 24). In other words, it is contemplated that the background coloration or three-dimensional texture of the hat construction 10 may match or complement the coloration or texture of the cinch means. In this regard, it is contemplated that the camouflaging feature or means may well function enhance the fashionable appeal of the hat construction 10.

Certain accessories are further contemplated that may be utilized in conjunction with the hat construction 10 in order to enhance its utility and/or fashionable appeal. In this regard, it is contemplated that certain aperture-patching means and/or certain moisture-wicking means may be cooperatively associated with the hat construction 10. The aperture-patching means may well function to patch the aperture or close the opening 101 when the user does not wish to utilize the hat as a hat-gathering device, but rather don the hat in the conventional manner with no obviously apparent or evident hair letting apertures. The moisture-wicking means may well function to wick moisture or perspiration away from the head as received within the hat construction 10 so as to enhance the comfort of the hat when donned.

The aperture-patching means may be preferably defined by patch or patch-like structure 27 is generally illustrated and referenced in FIG. 7. FIG. 7 is a view of the aperture 101 as viewed from within the hat construction 10. In other words, it is contemplated that the patch 27 may cover the opening from within the hat construction 10 and attach to hat via various means for removably fastening the patch 27 thereto, such as cooperable VELCRO brand hook and loop fastening structure 28 further referenced in FIG. 7. Alternative means of attaching patch-like structures 27 to the hat construction may include zipper means. A generic zipper-like structure 29 is illustrated in FIG. 8 bordering the aperture 101 and attached to the upper and lower hair-receiving notches 21 and 23.

Figure 18:
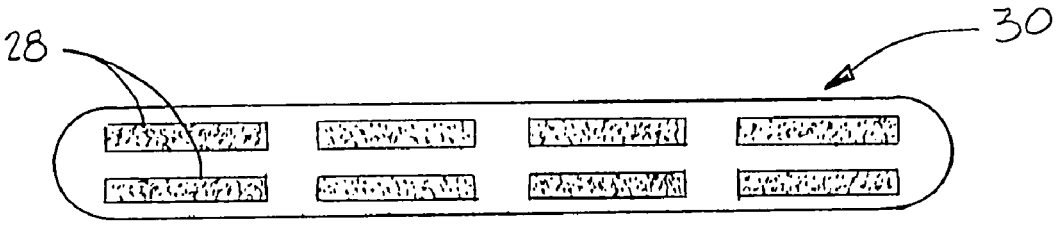
FIG. 18 is a plan view of a sweatband type accessory that may be utilized in combination with the hat construction according to the present invention.

The moisture-wicking means may be preferably defined by a sweat band 30 comprising moisture-wicking and washable material as generally illustrated and referenced in FIG. 18. It is contemplated that the sweatband 30 may be similarly removably attached to the inner hat surface adjacent the crown portion 11, as may be needed or desired by the user, to wick moisture or perspiration away from the user's head and/or face. The moisture-wicking means may thus be removed and washed as may be required for proper hat maintenance. It is contemplated that the sweatband 30, or similar other such elements, may be outfitted upon the hat construction 10 as a means to add layers thereto and hence provide extra thermally insulating properties to the hat construction, as elected by the uses.

Figure 10:
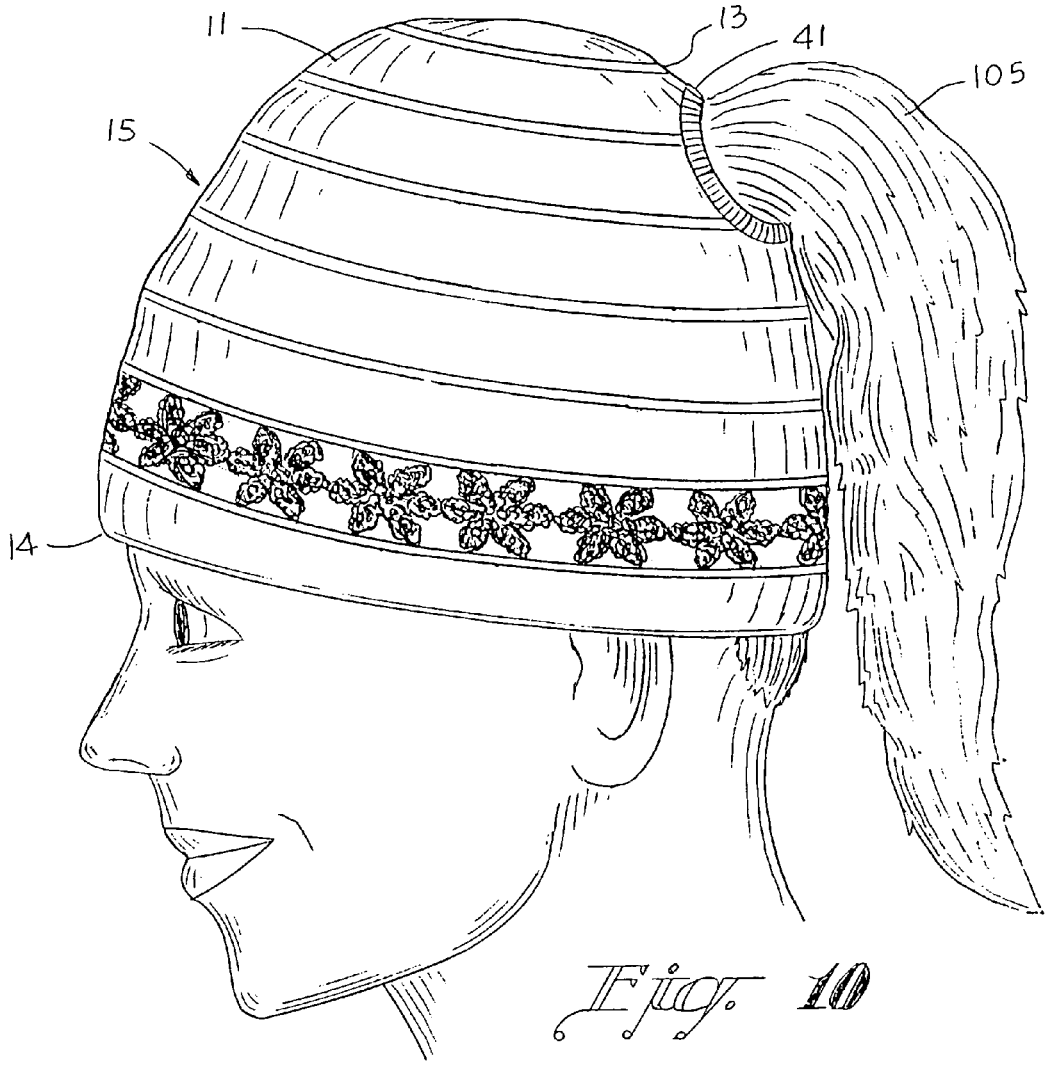
FIG. 10 is a lateral type depiction of the alternative hat construction otherwise depicted in FIG. 9 as donned upon a user's head with a ponytail structure extending from the hair-letting aperture.
Figure 11:
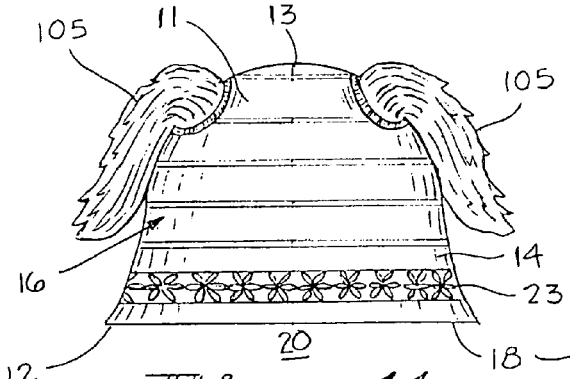
FIG. 11 is a posterior type depiction of the alternative hat construction according to the present invention with laterally oriented hair-letting apertures and pigtail structures formed via the hair-letting apertures.
Figure 12:
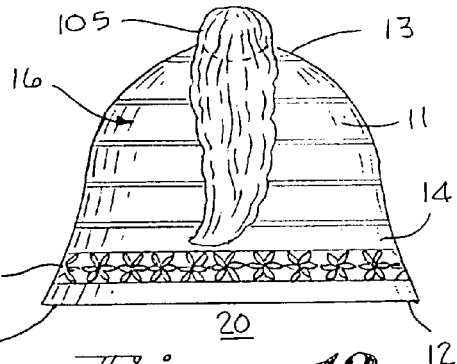
FIG. 12 is a posterior type depiction of the alternative hat construction according to the present invention with a posteriorly oriented hair-letting aperture for effecting a ponytail structure.

As earlier stated, an alternative embodiment of the hat construction 20 is generally depicted in FIGS. 9-12. The alternative embodiment of the hat construction 20 is believed to highly resemble the preferred embodiment of the hat construction 10 insofar as both embodiments function to gather hair via certain hair-gathering structure incorporated into the body of the hat. Hat construction essentially eliminates the disconnect or discontinuity at the brim portion 12 and repositions the hair letting aperture 101 toward the superior crown portion away from the crown-to-brim junction so that hair may be entrained and directed in superior direction(s) as generally depicted in the noted figures. Preferably, hair 105 may be further entrained in a posterior direction for a ponytail type effect as generally depicted in FIG. 12, or entrained in lateral direction(s) for a pigtail type effect as generally depicted in FIG. 11.

Whether hat construction 10 or 20 is practiced, it is contemplated that the hat construction may well function to gather hair via certain elasticity at the site of the aperture 101. As introduced earlier, aperture 101 may be bound by an elastic structure for enabling a hair-receiving, actuated configuration as generally depicted in FIGS. 13 and 14 and a hair-gathering, relaxed configuration as generally depicted in FIGS. 15 and 16. In other words, in the actuated configuration, the diameter of the aperture is increased so as to enable eased receipt of entrained hair 105. After the hair is received through the opening 101, it may be gathered/pinched by relaxing the structure defining the opening 101, and reducing its diameter.

The hair-gathering hat construction 20 may thus be said to effect a hair-gathering aperture such that the crown portion is peripherally discontinuous at a section thereof for forming a hair-gathering site, into which may be received a certain hair gathering assembly 40, which assembly 40 is generally illustrated and referenced in FIGS. 13-16. The hair gathering assembly 40 essentially comprises a centralized hair-gathering elastic annulus 41 and an annulus-expansion interface 42 concentric with the annulus 41 and extending radially therefrom. The interface 42 is attached to the crown portion 11 at the hair-gathering site and comprises flexible fibers 43 extending radially from the crown portion to the annulus 41. From a comparative inspection of FIGS. 13 and 14 versus FIGS. 15 and 16, it may be seen that the annulus 41 is actuable intermediate the relaxed, hair-gathering configuration (see FIGS. 15 and 16) and an actuated, hair-receiving configuration (see FIGS. 13 and 14). It may be readily seen that the flexible fibers 43 are flexibly deformed or folded when the annulus 41 is in the hair-receiving configuration and flexibly restored or elongated when the annulus 41 is in the hair-gathering configuration.

When in a relaxed configuration as generally depicted in FIGS. 15 and 16, it is contemplated that the diameter of the annular opening 101 is on the order of 1 inch (2.54 centimeters). When in an actuated configuration as generally depicted in FIGS. 13 and 14, it is contemplated that the diameter of the annular opening 101 is on the order of 3 inches (7.6 centimeters). The opening of about one inch makes the hat more attractive than the prior art, and because it is made with elastic, it can serve as a ponytail holder on any hat unlike the prior art.

Prior art disclosures generally state that entrained hair must be in a ponytail configuration before installation through prior art hat-borne hair outlets. With the present invention, however, the actual headgear itself functions to cinch the gathered or entrained hair into a tail-like configuration. It is contemplated that the opening 101 of hat construction 20 may be situated on the crown of the head, the side of the head, or the back of the head, or in multiple locations about the head (as might be the case, for example, if the wearer desired a pigtail type configuration).

Thus, while the above description contains much specificity, this specificity should not be construed as limitations on the scope of the invention, but rather as an exemplification of the invention. For example, as is described hereinabove, it is contemplated that the present invention essentially discloses a hair-gathering hat construction for effecting a hair-gathering aperture, which hat construction essentially comprises a crown portion, a brim portion, and certain cinching means.

The crown portion defines a head-receiving opening and comprises superior, inferior, anterior, and posterior crown sections. The superior crown section is peripherally continuous, and the inferior crown sections are peripherally discontinuous at or adjacent certain crown sections for defining at least one upper hair-receiving notch. The brim portion defines certain discontinuous head-receiving structure and comprises superior, inferior, anterior, and posterior brim sections, as well as brim termini in view of the discontinuous structure.

The superior brim section integrally extends from the inferior crown section from a crown-to-brim junction. Certain of the brim sections define at least one lower hair outlet. Together, the upper and lower hair outlets define a hair gathering aperture. The brim termini, which may optionally overlap, form an annular head-receiving structure when juxtaposed one another. The cinching means may be defined by means for retaining the brim termini in overlapped relation when juxtaposed one another, and further may be defined by certain tying means or strapping means for cinching the crown and brim portions against a head as received via the brim and crown portions.

Notably, when the head-attached hair 105 is pulled through the hole or opening 101 defined by the annulus 41, there should be hardly any hair visible by the neck as generally depicted in FIG. 10. In this regard, it should be noted that the target population of users may be defined by those people having full heads of hair (lots of hair). Conceivably, users with thin or very little hair would not benefit greatly from use of the hat constructions 10 or 20 since the annulus 41 or aperture 101 defined thereby is designed to gather/pinch some relatively greater quantity of hair 105 together as generally depicted in the various figures.

With regard to the embodiments generally shown in FIGS. 1-4, it should be noted that when the hat construction comprises buckle type strap 24, versions are contemplated in which the strap 24 may be detached from the hat construction 10 and made of differing lengths (for either completely encircling the hat or ornamentally outfitted an arcuate portion thereof) for effecting different looks or styles. The straps 24 may attach with snaps or VELCRO brand hook and loop fastening means (which function to affix adjacent structure otherwise stitched to the crown-to-brim junction.

In this last regard, it should be noted that the crown-to-brim junction is not necessarily pronounced or demarcated with a clear boundary. In other words, the demarcation line intermediate the two sections 14 and 17 is not necessarily structurally clear. The brim portion 12 thus slants incrementally away from the crown portion 11, which crown portion is contemplated to primarily follow the contour of the upper portions of a user's head. Thus, the brim portion 12 may be defined by that portion not immediate in contact with the crown portion of the head, or as that portion comprising the brim termini 25.

It is further contemplated that the essential concepts may be extended to virtually any style of hat, including sunhats, ski hats, cap, skull caps, and hats with brims of all sizes) and that the materials may include any fabric (including, but not limited to fleece, jersey, cotton, linen, denim, synthetic straw, hemp, leather, suede, etc) so long as the material is pliable enough to support essence of the invention, as set forth hereinabove is practiced. If the hat were to be made from straw or synthetic straw and collar blends, then the stitch will naturally have to be repeated to remain more secure. This way it is more durable.

It is contemplated that the patch 27 may preferably attach to the inner hat surface via cooperable snaps, VELCRO brand hook and loop fastening means (as generally depicted in Figure No.) or a zipper (as generally depicted in Figure No.). The section of fabric or patch means that attaches to the hat construction or otherwise fill or selectively cover the opening 101 may be outfitted or further accessorized with such ornamental items such as flower-like configurations. In this regard, it is contemplated that the ornamental items may radially protrude through or from the opening 101 adjacent the user's head so as to enhance the overall effect of the hair-gathering hat construction.

Other detachable elements such as washable sweatbands and the like may be further included in the design as a means to absorb moisture. It is contemplated that the sweatband 30 as generally depicted in FIG. 18 may attach to the inside surface of the hat construction(s) 10 or 20 via snaps or VELCRO brand hook and loop fastening means. This sweatband 30 essentially functions to prevent perspiration from migrating to the user's face when the hat construction is donned in during warmer periods. When the ambient temperatures are cooler, it is contemplated that the sweatband 30 may add a layer for increasing the insulative properties of the hat construction.

The overlapping nature of the brim termini 25 functions to allow for adjustability. If that hat construction requires adjustment for receiving bigger or larger heads, then the brim portion 12 may be loosened via the cinching means and the overlapping brim termini 25 allow for the hat construction 10 so that the construction visually appears well fit to the head (or as if the construction is a one-size-fits all type garment). It is contemplated that the brim termini 25 are preferably mirror images of one another so that overlapping may be done via either brim terminus 25.

It is further contemplated that the foregoing specifications support certain hair-gathering methodology for gathering head-attached hair 105 via a hat construction 10. In this regard, it is believed that the hair-gathering method according to the present invention may be said to comprise the steps of: receiving a head into the crown portion 11 of a hat construction 10, the head having hair 105 extending radially therefrom, which hair 105 may be manually (and posteriorly or laterally) entrained into one or more tail-like structure(s). Notably, the entrainment of hair 105 may occur before the step of receiving the head into the crown portion 11, and thus the actual sequential placement of language in a claim structure should not necessarily be construed as limiting.

The entrained hair 105 may then be (manually) lifted (as at vector arrow 106 in FIG. 17) and received into an upper hair-receiving notch 21 pre-formed at certain inferior sections of the crown portion 11. The brim termini 25 of the hat construction 10 may thereafter be juxtaposed in inferior adjacency to the lifted hair 105, which brim termini 25 may overlap and may be fastened (by way of strap structure 24 or cord-like structure 26) if desired. The lifted hair 105 may then be aligned over a lower hair-receiving notch (as at 23) as defined by superior sections of the brim termini 25. A hair-gathering hair outlet (as at 101) is formed via the upper and lower hair-receiving notches 21 and 23, and the entrained hair 105 is thus supported via the hair-gathering hair outlet 101 for gathering head-attached hair 105 via the hat construction 101.

Figure 19:
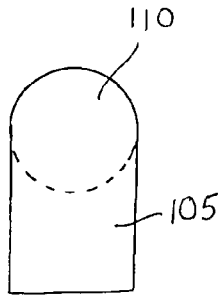
FIG. 19 is a diagrammatic depiction of the back of a user's head with head-attached hair hanging freely under its own weight from the head.
Figure 20:
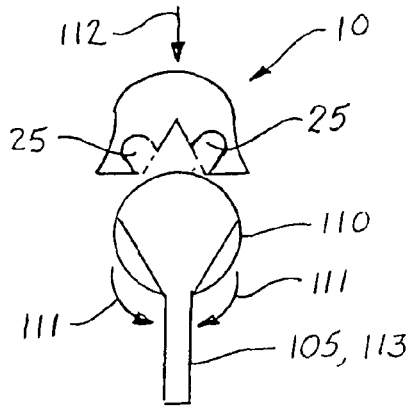
FIG. 20 is a diagrammatic depiction of the back of the user's head otherwise shown in FIG. 19 with the hair entrained into a ponytail structure and a hat construction with brim termini in an open state being donned upon the head.
Figure 21:
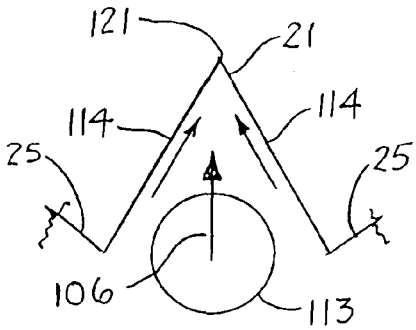
FIG. 21 is a fragmentary enlarged plan type diagrammatic depiction of the upper hair-receiving notch of the hat construction with a cross section of the ponytail structure being channeled toward the upper notch terminus or groove of the upper hair-receiving notch.

The sequential steps are perhaps more clearly illustrated with reference to FIGS. 19-24, inclusive, which sequentially depict in a diagrammatic manner the steps supported by the hat construction 10 of the present invention. FIG. 19 roughly depicts the back of a user's head 110 with head-attached hair 105 extending radially therefrom and hanging freely under its own weight. FIG. 20 roughly depicts the step of receiving the user's head 110 into the hat construction 10 (as at arrow 112) which hair 105 has been manually and posteriorly entrained (as depicted at arrows 111) into a single tail-like structure 113. Note that the hat construction 10 in FIG. 20 depicts the brim termini 25 in a folded out configuration for clarity.

Figure 22:
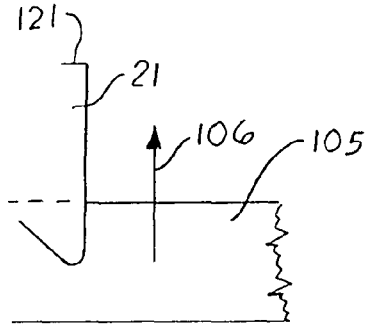
FIG. 22 is a fragmentary enlarged side type diagrammatic depiction of the structure otherwise depicted in FIG. 21.
Figure 23:
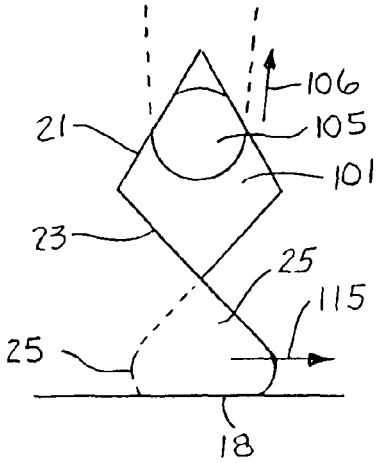
FIG. 23 is a fragmentary plan type diagrammatic depiction of the upper and lower hair-receiving notches of the hat construction with the ponytail structure being lifted and channeled toward the upper notch terminus or groove of the upper hair-receiving notch, and the brim termini being juxtaposed in overlapping relation to one another.
Figure 24:
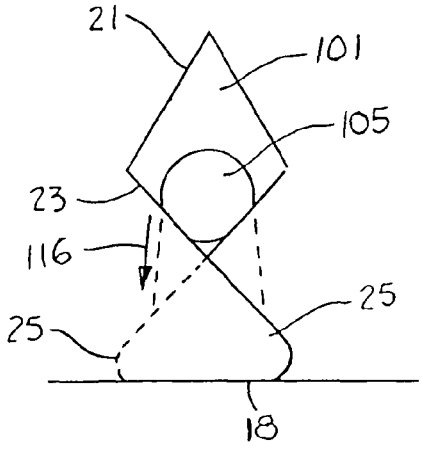
FIG. 24 is a fragmentary plan type diagrammatic depiction of the upper and lower hair-receiving notches of the hat construction with the ponytail structure being released and channeled toward a lower notch terminus or groove of the lower hair-receiving notch under its own weight.

The entrained hair 105 may then be (manually) lifted (as at vector arrow 106 in FIG. 17) and received into an upper hair-receiving notch 21 pre-formed at certain inferior sections of the crown portion 11. This step is diagrammatically depicted in FIG. 21, which shows from a plan type view, the upper hair-receiving notch 21 and a transverse cross section of structure 113 being lifted as at 106. Arrows 114 depict the likely channeling of hair 105 toward a notch terminus 121, when the hair 105 contacts the notch 21. FIG. 22 depicts the structure in FIG. 21 from a side view.

The brim termini 25 of the hat construction 10 may thereafter be juxtaposed (as referenced at arrow 115) in inferior adjacency to the lifted hair 105, which brim termini 25 may overlap and may be fastened (by way of strap structure 24 or cord-like structure 26) if desired. The lifted hair 105 may then be aligned over a lower hair-receiving notch (as at 23) as defined by superior sections of the brim termini 25. A hair-gathering hair outlet (as at 101) is formed via the upper and lower hair-receiving notches 21 and 23, and the entrained hair 105 may then be released at which time it falls under its own weight as at vector arrow 116 and thus becomes supported via the hair-gathering hair outlet 101 and/or the lower hair-receiving notch 23 for gathering head-attached hair 105 via the hat construction 101.

Although the invention has been described by reference to several embodiments and certain methodology, it is not intended that the hat construction and hair gathering method be limited thereby, but that modifications thereof are intended to be included as falling within the broad scope and spirit of the foregoing disclosure and the appended drawings.

I claim:

1. A hair-gathering hat construction for effecting a hair-gathering aperture, the hat construction comprising:

a crown portion, the crown portion defining a head-receiving opening and comprising superior, inferior, and posterior crown sections, the superior crown section being peripherally discontinuous at the posterior crown section thereby forming a hair-gathering site, the inferior crown section being peripherally continuous;

a hair gathering assembly, the hair gathering assembly comprising a centralized hair-gathering elastic annulus and an annulus-expansion interface concentric with the annulus and extending radially therefrom, the interface being attached to the crown portion at the hair-gathering site and comprising flexible fibers extending radially from the crown portion to the annulus, the annulus being actuable intermediate a relaxed, hair-gathering configuration and an actuated, hair-receiving configuration, the flexible fibers being flexibly deformed when the annulus is in the hair-receiving configuration and flexibly restored when the annulus is in the hair-gathering configuration, the annulus thereby providing a hair-gathering aperture; and means for patching the hair-gathering aperture.

2. The hair-gathering hat construction of claim 1 wherein the means for patching the hair-gathering aperture are defined by a patch, the patch being sized and shaped to close the hair-gathering aperture when the annulus is in the hair-gathering configuration.

3. The hair-gathering hat construction of claim 2 wherein the means for patching the hair-gathering aperture are fastened to the annulus via fastening means.

4. The hair-gathering hat construction of claim 3 wherein the fastening means are defined by hook and loop type fastening means, the patch being sized and shaped to cover the annulus when the annulus is in the hair-gathering configuration.

5. The hair-gathering hat construction of claim 3 wherein the fastening means are defined by zipper type fastening means, the zipper means and patch together being sized and shaped to cover the aperture when the annulus is in the hair-gathering configuration.

6. A hair-gathering hat construction for effecting at least one hair-gathering aperture, the hat construction comprising:

a crown portion, the crown portion, defining a head-receiving opening and comprising superior, inferior, lateral, and posterior crown sections, the superior crown section being peripherally discontinuous thereby fanning at least one hair-gathering site, the inferior crown section being peripherally continuous;

a hair gathering assembly, the hair gathering assembly comprising at least one hair-gathering annulus and at least one annulus-expansion interface concentric with each respective annulus and extending radially therefrom, each interface being attached to the crown portion at a respective hair-gathering site and comprising flexible fibers extending radially from the crown portion to each respective annulus, each annulus being actuable intermediate a relaxed, hair-gathering configuration and an actuated, hair-receiving configuration, the flexible fibers being flexibly deformed when each annulus is in the hair-receiving configuration and flexibly restored when each annulus is in the hair-gathering configuration, each annulus thereby providing a hair-gathering aperture; and means for selectively covering each hair-gathering aperture.

7. The hair-gathering hat construction of claim 6 wherein the means for selectively covering each hair-gathering aperture are defined by at least one patch, each patch being sized and shaped to close the respective hair-gathering aperture when each respective annulus is in the hair-gathering configuration.

8. The hair-gathering hat construction of claim 7 wherein the means for selectively covering each hair-gathering aperture are fastened to each respective annulus via fastening means.

9. The hair-gathering hat construction of claim 8 wherein the fastening means are defined by hook and loop type fastening means, each patch being sized and shaped to cover each respective annulus when the respective annulus is in the hair-gathering configuration.

10. The hair-gathering hat construction of claim 8 wherein the fastening means are defined by zipper type fastening means, the zipper means and patch together being sized and shaped to cover the cover each respective hair-gathering aperture when each respective annulus is in the hair-gathering configuration.

11. The hair-gathering hat construction of claim 6 wherein each hair-gathering aperture is bound by elastic for effecting an enhanced hair-gathering function.

12. The hair-gathering hat construction of claim 6 wherein the superior crown section is peripherally discontinuous at the lateral crown sections for forming spaced hair-gathering sites, the spaced hair-gathering sites for locating at least two spaced hair-gathering apertures.

13. A hair-gathering hat construction for effecting at least one hair-gathering aperture, the hat construction comprising a head-receiving crown portion and a hair-gathering assembly, the crown portion comprising superior and inferior crown sections, a select crown section being peripherally discontinuous thereby forming at least one hair-gathering site, the hair gathering assembly comprising at least one hair-gathering annulus and at least one annulus-expansion interface concentric with each respective annulus and extending radially therefrom, each interface being attached to the crown portion at a respective hair-gathering site and comprising flexible fibers extending radially from the crown portion to each respective annulus, each annulus being actuable intermediate a relaxed, hair-gathering configuration and an actuated, hair-receiving configuration, the flexible fibers being flexibly deformed when each annulus is in the hair-receiving configuration and flexibly restored when each annulus is in the hair-gathering configuration, each annulus thereby providing a hair-gathering aperture; and means for selectively covering each hair-gathering aperture.

14. The hair-gathering hat construction of claim 13 wherein the means for selectively covering each hair-gathering aperture are defined by at least one patch, each patch being sized and shaped to close the respective hair-gathering aperture when each respective annulus is in the hair-gathering configuration.

15. The hair-gathering hat construction of claim 14 wherein the means for selectively covering each hair-gathering aperture are fastened to each respective annulus via fastening means.

16. The hair-gathering hat construction of claim 15 wherein the fastening means are defined by hook and loop type fastening means, each patch being sized and shaped to cover each respective annulus when the respective annulus is in the hair-gathering configuration.

17. The hair-gathering hat construction of claim 15 wherein the fastening means are defined by zipper type fastening means, the zipper means and patch together being sized and shaped to cover the cover each respective hair-gathering aperture when each respective annulus is in the hair-gathering configuration.

18. The hair-gathering hat construction of claim 13 wherein each hair-gathering aperture is bound by elastic for effecting an enhanced hair-gathering function.

19. The hair-gathering hat construction of claim 13 wherein the superior crown section is peripherally discontinuous for forming spaced hair-gathering sites, the spaced hair-gathering sites for locating at least two spaced hair-gathering apertures.

* * * * *